United States Patent [19]

Taylor

[11] Patent Number: 4,971,260

[45] Date of Patent: Nov. 20, 1990

[54] CLAY CRUSHING MACHINE

[75] Inventor: Harry Taylor, Wakefield, England

[73] Assignee: Craven Fawcett Limited, Wakefield, England

[21] Appl. No.: 463,145

[22] Filed: Jan. 9, 1990

Related U.S. Application Data

[63] Continuation of Ser. No. 279,762, Dec. 5, 1988, abandoned.

[30] Foreign Application Priority Data

Dec. 5, 1987 [GB] United Kingdom ..... 8728512

[51] Int. Cl.[5] ..... B02C 4/08

[52] U.S. Cl. ..... 241/89.3; 241/158; 241/235; 241/294

[58] Field of Search ..... 241/73, 235, 294, 295, 241/290, 89.2, 89.3, 88.4, 158, 293

[56] References Cited

U.S. PATENT DOCUMENTS 271,588 2/1983 Anderson ..... 241/235

3,722,805 3/1973 Strom ..... 241/89.3 X

*Primary Examiner*—Mark Rosenbaum

*Attorney, Agent, or Firm*—Fred Philpitt

[57] ABSTRACT

The invention relates to a machine for the crushing of clay-like mineral materials to prepare them for a subsequent process such as brick-making, the machine comprising a pair of parallel rotors defining therebetween a crushing gap, and a perforated grid adjacent one or each rotor to define therewith a sizing gap.

4 Claims, 3 Drawing Sheets

CLAY CRUSHING MACHINE

This is a continuation of application Ser. No. 279,762 filed Dec. 5, 1988, now abandoned, and the benefits of 35 USC 120 are claimed relative to it.

The invention relates to machines for the crushing of mineral substances and in particular of various types of clay.

Clay, whether in the form of marl, which is substantially wet, or of shale which is relatively dry, is generally quarried or otherwise extracted in lumps of very varied size, and hither to a crushing machine has been employed to break the largest lumps down to a manageable size, and a further machine, such as a wet pan mill, has been required to reduce the particle size down to something of the order of 9 mm so as to prepare it for subsequent process such as brick-making.

The machines hitherto employed are massive, occupy a great deal of floor space, and require exceedingly robust foundations. All of these requirements are costly to provide, and it is an object of the present invention to reduce these requirements by the elimination of one machine.

According to the invention there is provided a machine for the crushing and sizing of mineral substances such as clay comprising a pair of parallel rotors defining between them a crushing gap, and perforated grid means spaced from at least one of the said rotors so as to define a sizing gap therebetween, and means for driving the rotors to crush lumps of mineral introduced therebetween and to press the thus-crushed material through the perforations of said grid.

Preferably each of the rotors is of such multi-lobal section transverse to the axis and is fixed to the axis of the rotor in such an angular position that the closest distance between the surface of mutually aligned portions remains constant as the rotors rotate. Preferably the rotors are tri-lobal in section Preferably the surface of each of the rotors comprises two or more length portions, the length portions of one rotor being aligned with the length portions of the other so that the surfaces defined by mutually aligned portions exert a crushing action on the lumps of mineral substance.

Embodiments of the invention will now be described by way of example and with reference to the accompanying drawings of which:

Figure 1:
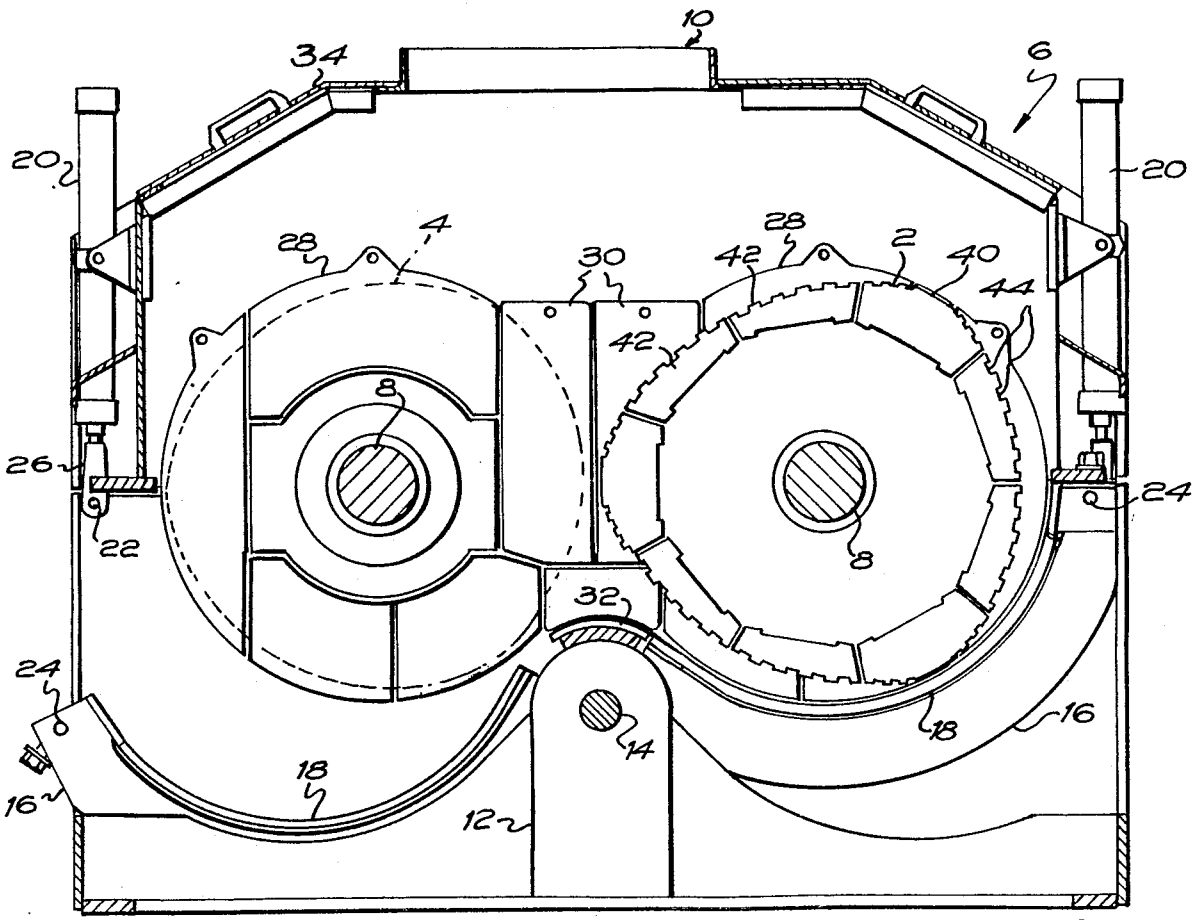
FIG. 1 is a section through the centre line of a clay crushing machine.

As shown in FIG. 1 the machine primarily consists of two rotors, 2 and 4 mounted for rotation about horizontal axes 8 within a housing 6. The housing 6 is provided with access doors 34 and an opening 10 above and between the rotors for the introduction of clay lumps to be treated.

Below and between the rotors are pillars 12, spaced apart lengthwise of the rotors. The pillars support a horizontal axis 14 upon which are pivoted two similarly spaced pairs of arcuate plates 16, one pair being under each of the rotors. Between the plates of each pair extends a grid 18 which is slotted lengthwise, that is to say perpendicularly to the axes 8.

Figure 3:
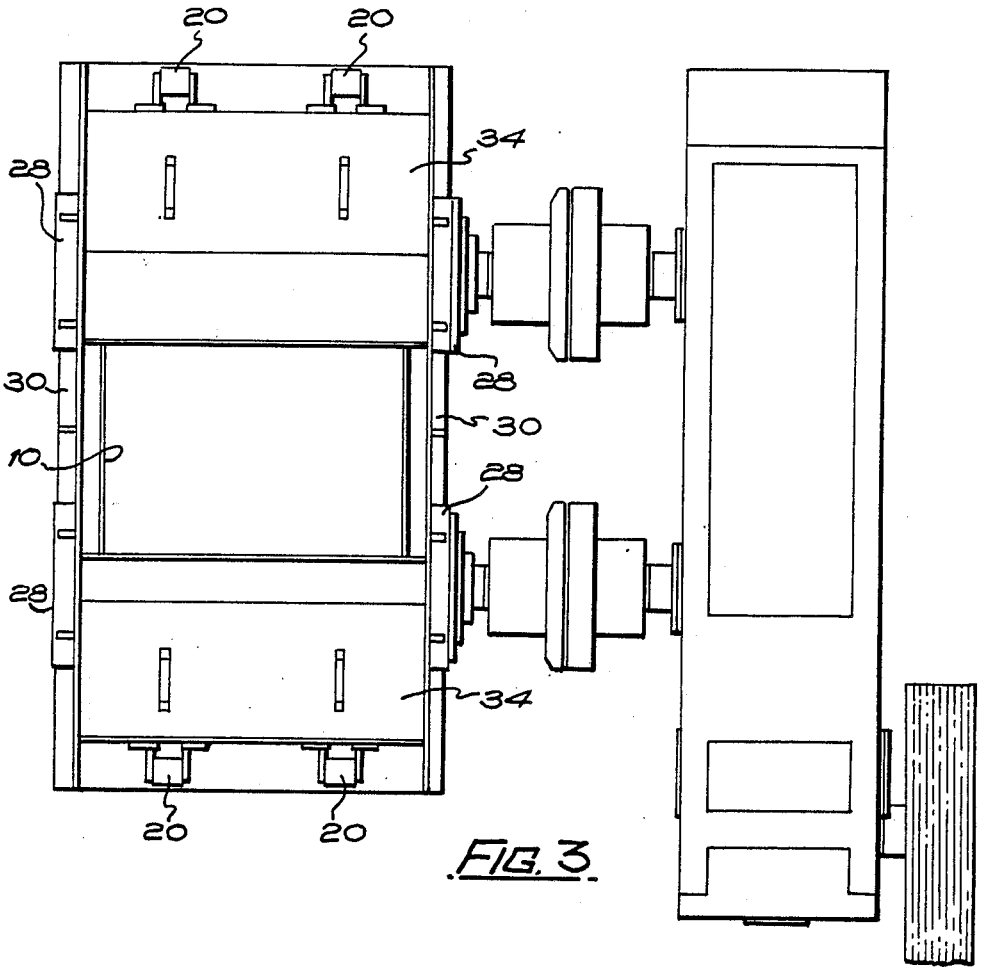
FIG. 3 is a general plan view of the machine of FIG. 1.

As shown to the right of FIG. 1, that is to say under the rotor 2, one of the plates 16 is shown connected at its end remote from axis 14 to the ram of a vertically mounted pneumatic cylinder 20. (The other of the plates 16 associated with rotor 2, not shown in FIG. 1, is also connected to a pneumatic cylinder 20 shown in FIG. 3.) In this, the in-use, position, the grid 18 is seen to be close to the under-side of the rotor 2 and as will be explained later the juxtaposition of the grid and the turning rotor results in a pressing of the clay substance through the slots of the grid.

As shown to the left of FIG. 1, under rotor 4, a pin (not shown) has been removed which connected the eye 22 of the shackle 26 of the ram of the cylinder 20 to the hole 24 in the end of one of the plates 16, so that the plate has swung downwardly about the pivot 14 for access to the grid 18 for maintenance purposes.

At each end of the rotors 2, 4 are wear plates 28 and, between the individual rotors are further wear plates 30. Below the opening 10 and above and between the pillars 12 an upwardly convex plate 32 is arranged to direct clay particles that have passed downwardly between the rotors onto one or other of the grids 18.

As will be seen from the FIG. 1, the transverse section of the rotors has a generally trilobal shape, and is made of three similarly shaped segments 40, and six segments 42, similar to one another but different from the segments 40. The segments 42 are arranged in pairs, one of which is reversed relative to the other, between two segments 40. The peripheral surface of each of the segments is provided with axial grooves 44.

The shape of rotor 4 is shown only in outline, but it will be observed that, not only is it of the same tri-lobal shape as rotor 2, but the parts of the circumference of largest diameter occupy the same angular position as in rotor 2. The rotors are arranged to rotate, however, in opposite directions, the rotor 2 anticlockwise as shown in the figure, and the rotor 4 clockwise. As the rotors are shown, the periphery of rotor 2 nearest to rotor 4 is almost at the centre line between the axes 8, the radius being a maximum at that point, whilst the radius of rotor 4 is a minimum at the point of nearest approach to rotor 2, and is remote from the centre line by a distance which experience shows corresponds to the maximum particle size that can conveniently be pressed through the grids 18.

As the rotors rotate through 60 degrees the surface of the rotor 2 nearest rotor 4 retreats from the centre line whilst the surface of rotor 4 nearest rotor 2 advances towards the centre line to the same extent so that the spacing between the rotor surfaces at their closest approach remains constant. During the next 60 degrees of rotation, rotor 2 advances and rotor 4 retreats in similar manner. The rotors are kept is strict synchronism so that as they continue to rotate the spacing remains constant although the mid point between them shifts periodically from one side to the other of the centre line.

As the rotors revolve, any clay lumps introduced between them which are of size greater than the constant spacing between the rotors become crushed, the fragments falling onto the plate 32 and thence being directed to the grids 18 for further treatment.

Considering now the relationship between the rotors and the grids 18, it will be seen that as each portion of large radius, that is to say as each segment 40, approaches any particular portion of the length of the grid 18, the distance between the rotor surface and the grid diminishes and it will be understood that any lump of clay above a minimum size and resting on the grid at that position will be pressed onto and through the grid, thus reducing the maximum size of the particles to that of the grid.

If any particularly hard piece of clay or a foreign body finds its way onto the grid and cannot be forced through the slots, the grid could be arranged to be forced downwardly about the axis 14 under the control of the cylinder 20 which would then subsequently restore the grid to its original position, though the prime function of the cylinders is to lower the grids 18 for maintenance. The above description applies, of course, to both rotors.

Figure 2:
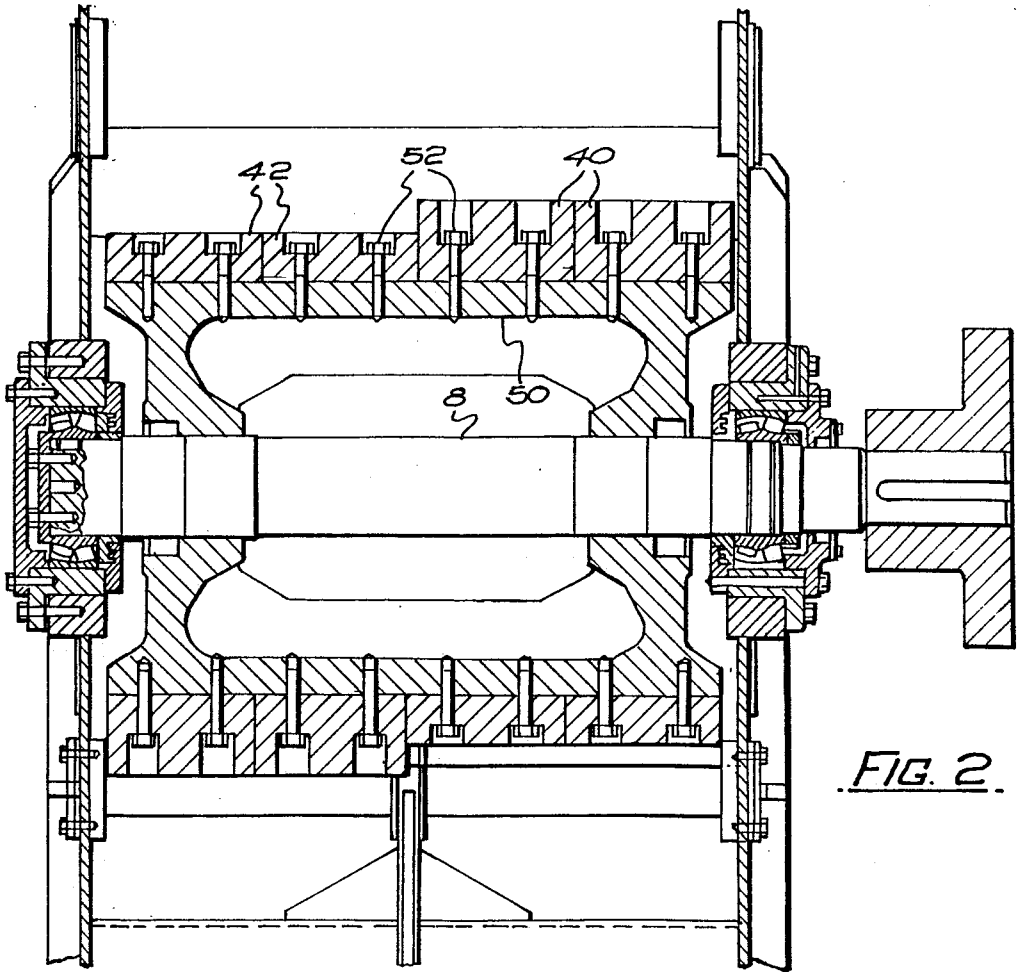
FIG. 2 is section through one of the rotors of FIG. 1.

In order to equate as far as possible the torque exerted by the two rotors, each is formed in two lengthwise portion as will be seen from FIG. 2 which shows a section of one of the rotors, it being understood that the other is similar. This shows that the rotor is formed of a hollow shell 50 locked to the shaft 8 and carrying, externally, the segments 40 and 42, secured thereto by bolts 52. For the reason of evening out the torque the surface of the rotor is divided lengthwise into two halves, one half being of maximum radius where the other half is of minimum radius. For ease of manufacture, repair and maintenance each half of each rotor is made of two segments 40 (or, as it were 42) arranged lengthwise. It will be understood that each half-length of each rotor is exactly like the other half-length but displaced by 60 degrees about the axis. Moreover the relationship between the respective rotors described above applies equally to the respective half-lengths thereof.

Whilst the appended claims seek to define the present invention as envisaged by the applicant at the time of submitting this application, the applicant reserves the right within the law to claim as an invention in general or specific terms, whether by way of divisional application or otherwise, any feature, method and/or aspect or any combination of features, methods and/or aspects disclosed herein which is or are subsequently identified to be inventive, and regardless of whether, in the case of a combination as aforesaid, the features, methods and/or aspects are disclosed individually in a single one of or in respective embodiments disclosed herein.

I claim:

1. A machine for the crushing and sizing of mineral substances comprising in combination:

(a) a first horizontal crushing rotor mounted for rotation about a first axis;

(b) a second horizontal crushing rotor mounted for rotation about a second crushing axis that is parallel to the first axis;

(c) means for rotating said rotors in synchronism;

(d) a first continuous non-circular circumferential crushing surface on said first rotor, (e) a second continuous non-circular circumferential crushing surface on said second rotor, (f) said first and second crushing surfaces forming a first crushing stage of the machine and being arranged to lie face-to-face continuously as the rotors rotate;

(g) said first and second rotors being spaced to rotate so as to define a crushing gap therebetween;

(h) said first and second axes being fixed in position and said first and second crushing surfaces being non-circular and complimentary so that the width of said crushing gap set forth in (g) remains fixed as the rotors rotate; and (i) at least one perforated grid means located adjacent to the underside of at least one of the first and second rotors and forming therewith a sizing gap whose width varies as the rotors rotate from a maximum size which is greater than said fixed crushing gap to a minimum size which is less than said fixed crushing gap to thus ensure that the rotor and grid means form a second crushing stage for the machine.

2. A machine according to claim 1 wherein each of said rotors is of multi-lobal section transverse to the axis.

3. A machine according to claim 1 wherein said rotors are tri-lobal.

4. A machine according to claim 1 wherein each rotor comprises at least two length portions in the axial direction, the length portions of one rotor being aligned with the length portions of the other so that the peripheral surfaces defined by mutually aligned portions can exert a crushing action on the lumps of mineral substances.

* * * * *